United States Patent [19]

Sherman

[11] Patent Number: 4,499,679

[45] **Date of Patent: * Feb. 19, 1985**

[54] ANTI-THEFT FRAME HANGING SYSTEM

[75] Inventor: Charles F. Sherman, Townsend, Mass.

[73] Assignee: Nielsen Moulding Design Corporation, Townsend, Mass.

[ * ] Notice: The portion of the term of this patent subsequent to May 31, 2000 has been disclaimed.

[21] Appl. No.: 484,493

[22] Filed: Apr. 13, 1983

[51] Int. Cl.[3] ..... F16M 13/00

[52] U.S. Cl. ..... 40/152.1; 248/551; 248/466

[58] Field of Search ..... 40/152.1, 152, 10 R; 248/551, 552, 553, 466, 474, 489, 490, 494, 495, 496

[56] References Cited

U.S. PATENT DOCUMENTS

| | | | |
|---|---|---|---|
| 1,883,834 | 10/1932 | Turner | 40/152.1 |
| 1,908,147 | 5/1933 | Hoegger | 248/466 |
| 2,928,199 | 3/1960 | Novak | 248/551 |
| 3,284,940 | 11/1966 | Putman | 248/551 |
| 3,597,869 | 8/1971 | Ruyle | 40/152.1 |
| 3,612,469 | 10/1971 | Dennis | 248/551 |
| 3,668,798 | 6/1972 | Mehl | 40/152.1 |
| 3,681,867 | 8/1972 | Bilodeau | 40/152.1 |
| 3,709,456 | 1/1973 | Pietsch | 248/551 |
| 3,912,216 | 10/1975 | Gano | 248/551 |
| 3,946,512 | 3/1976 | Shapiro | 40/152.1 |
| 3,952,436 | 4/1976 | Kuhnke | 248/551 |
| 4,074,888 | 2/1978 | Garner | 248/551 |
| 4,095,361 | 6/1978 | Ledenican | 40/152 |
| 4,385,744 | 5/1983 | Sherman et al. | 40/152.1 |

*Primary Examiner*—Gene Mancene
*Assistant Examiner*—James R. Hakomaki
*Attorney, Agent, or Firm*—John E. Toupal; Harold G. Jarcho

[57] ABSTRACT

A frame body for retaining a display article and having a rear surface that can be releasably secured to a support surface. Included in the invention is a releasable latch mechanism for attaching the rear surface to the support surface and movable between a locked position preventing removal of the frame body from the support surface and a release position allowing removal thereof. The latch mechanism comprises a release disposed between and substantially concealed by the frame body and the support surface and operable to move the latch mechanism to the release position so as to allow removal of the frame body. Also included in the invention are a plurality of spaced apart catch brackets for mounting on the support surface and adapted to releasably engage the rear surface and to be completely retained within receptacles defined thereby.

18 Claims, 6 Drawing Figures

ANTI-THEFT FRAME HANGING SYSTEM

BACKGROUND OF THE INVENTION

This invention relates generally to frame apparatus and, more particularly, to frame apparatus that can be locked in position on a support surface.

Art work is commonly displayed in many facilities to which the public has access and including, for example, office buildings, art galleries, museums, etc. Typically, the art work is retained by frames that are mounted on wall surfaces and the theft of such publicly displayed articles is an ever-increasing problem. Conventional hanging systems permit quick removal of frame retained art work that then can be concealed and removed from a facility in which it was displayed.

A hanging system for deterring the theft of frames is disclosed in U.S. Pat. No. 4,385,744 and assigned to the assignee of the present application. Although significantly improving security, the hanging system disclosed in the above noted application does have certain limitations. For example, the securing brackets disclosed are primarily useful for frames in which the display article is retained within a flange projecting outwardly from a rearwardly facing frame channel. Such a frame inherently entails frame channels of substantial depth. In addition, the latch mechanism specifically disclosed can under certain circumstances be moved into a release position without a proper removal actuator implement. By gently rocking a secured frame, a retained lip of a frame channel can be used as a camming surface to move a retained latch pivot member into a release position that permits removal of the frame body.

The object of this invention, therefore, is to provide a hanging system that will deter the unauthorized removal of frame retained articles from a support surface.

SUMMARY OF THE INVENTION

The invention is a frame body for retaining a display article and having a rear surface that can be releasably secured to a support surface. Included in the invention is a releasable latch mechanism for attaching the rear surface to the support surface and movable between a locked position preventing removal of the frame body from the support surface and a release position allowing removal thereof. The latch mechanism comprises a release means disposed between and substantially concealed by the frame body and the support surface and operable to move the latch mechanism to the release position so as to allow removal of the frame body. Also included in the invention are a plurality of spaced apart catch brackets for mounting on the support surface and adapted to releasably engage the rear surface and to be completely retained within receptacles defined thereby. The concealed latch mechanism provides attachment security and the receptacle retained catch brackets facilitate use of the invention with a frame body composed of rearwardly opening channels that form an outer periphery for the display article.

According to one feature of the invention, securing members are provided for attaching the brackets to the support surface and the securing members are also fully retained within the frame receptacle portions. Retention of the securing members within the frame receptcales permits the rear surface of the frame body to fit flushly against the support surface and minimizes the lever arm available to pry the frame off the surface.

According to another feature of the invention, the frame body's rear surface defines rearwardly facing channels terminating with inwardly extending lips, the channels and lips form the receptacle portions and the bracket members comprise base portions projecting away from the support surface and hook portions extending substantially parallel thereto and engaged by the lips. Additionally defined by the frame body are spaced apart retaining flange portions extending inwardly from the channels and adapted to straddle the outer periphery of the display article, This arrangement provides a display frame having a frame body of minimum depth.

Also encompassed by the present invention is a frame body for retaining a display article and having a rear surface adapted for attachment to a support surface and defining rearwardly facing channels terminating with inwardly extending lips. Securing the frame body to the support surface are a plurality of spaced apart catch members for releasably engaging the channels and a latch mechanism including a latch body attached to the support surface and a pivot member pivotally retained by the latch body and movable between a locked position that prevents removal of the frame body from the support surface and a release position that allows removal thereof. The pivot member defines a locking portion that engages an inner surface of one of the lips when in the locked position and a concealed release portion operable to move the pivot member into its release position to allow removal of the frame body. Defined by the locking portion is a step portion with an abutment edge extending substantially perpendicular to the engaged lip. The abutment edge on the locking portion contacts the edge of the engaged lip during any rocking motion of the frame body and thereby prevents the lips edge from camming the pivot member into its release position.

According to another feature of the invention, the latch mechanism includes a bias means biasing the pivot member into its locked position and the latch mechanism and channels are shaped and arranged such that during movement of the frame body into position on the support surface, the body's rear surface first engages and moves the pivot member into its release position and then permits the bias means to move the pivot member into its locked position within a retainer cavity portion of a channel. According to this arrangement, the latch mechanism is automatically engaged during positioning of the frame body on the support surface.

According to yet another feature of the invention, the invention includes an actuator having a handle portion and an actuator portion, the actuator adapted for manual manipulation whereby the actuator portion passes between the suppport surface and the frame body's rear surface to contact the latch release portion and move the pivot member into its release position. The actuator facilitates removal of the frame body from the support surface by one having the uniquely formed actuator implement.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
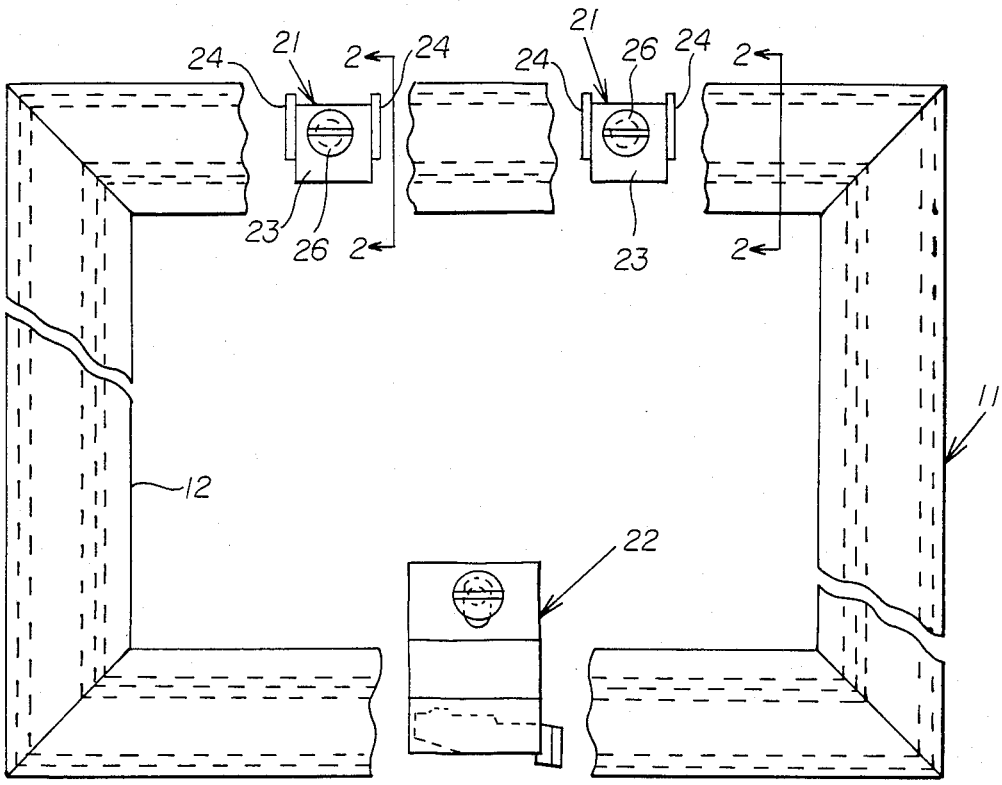
FIG. 1 is a schematic front view of a frame apparatus according to the invention.
Figure 2:
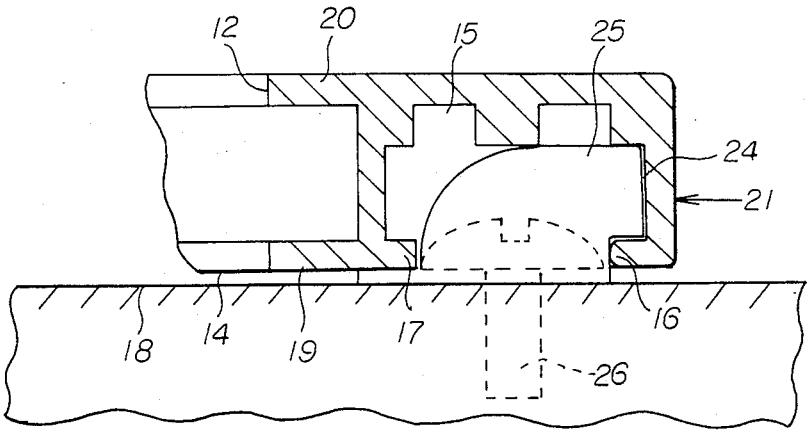
FIG. 2 is a partial cross-sectional view taken along lines 2—2 of FIG. 1.
Figure 3:
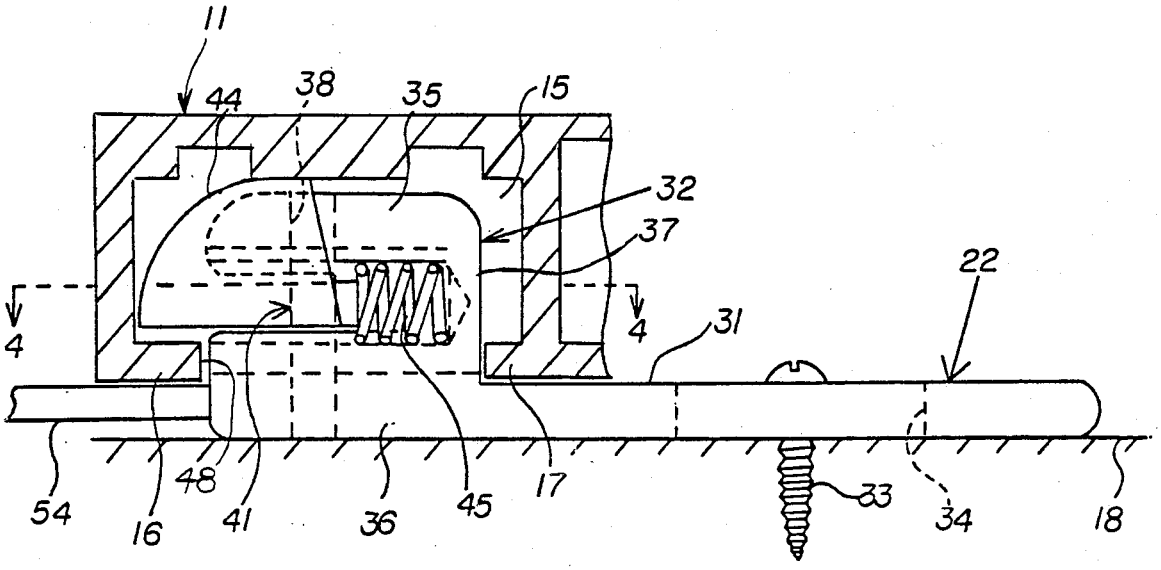
FIG. 3 is a partial schematic cross-sectional view taken along lines 3—3 of FIG. 1.

Illustrated in FIG. 1 is a rectangular frame body 11 having an inner border 12 adapted to enclose a display article (not shown) such as art work. As shown in FIGS. 2 and 3, a rear surface 14 of the frame body 11 defines a continuous, rearwardly facing channel 15 terminated by inwardly extending lips 16, 17. Extending inwardly from the channel 15 are spaced apart inner and outer flange portions 19 and 20 adapted to straddle the display article.

A system for securing the frame 11 to a support surface 18 includes a pair of spaced apart bracket catches 21 located on a top leg of the frame body 11 and a latching catch 22 located on a bottom leg thereof. As shown in FIGS. 1 and 2, each of the brackets 21 includes a base portion 23 and a parallel pair of hook portions 24 extending parallel to the support surface 18. Joining the hook portions 24 to the base portion 23 are a pair of base extension portions 25 projecting away from the support surface 18. The base portions 23 are secured to the support surface 18 by screws 26 having head portions engaging the base portions 23 and shank portions engaging the surface 18, the base extension portions 25 extend into the channel 15, and the outer edges of the hook portions 24 are retained by the outer inwardly extending lip 16. As shown in FIG. 2, the brackets 21 and the head portions of the securing screws 26 are retained substantially completely within receptacle portions of the channel 15. Thus, the securing screws 26 do not obstruct movement of the inner flange 19 into the illustrated position substantially flush with the support surface 18. In addition, this arrangement minimizes the transverse spacing between the hook portions 24 and the securing screws 26 thereby also minimizing the lever arm available to pry the screws 26 out of the surface 18 by pivoting the frame member 11.

Figure 4:
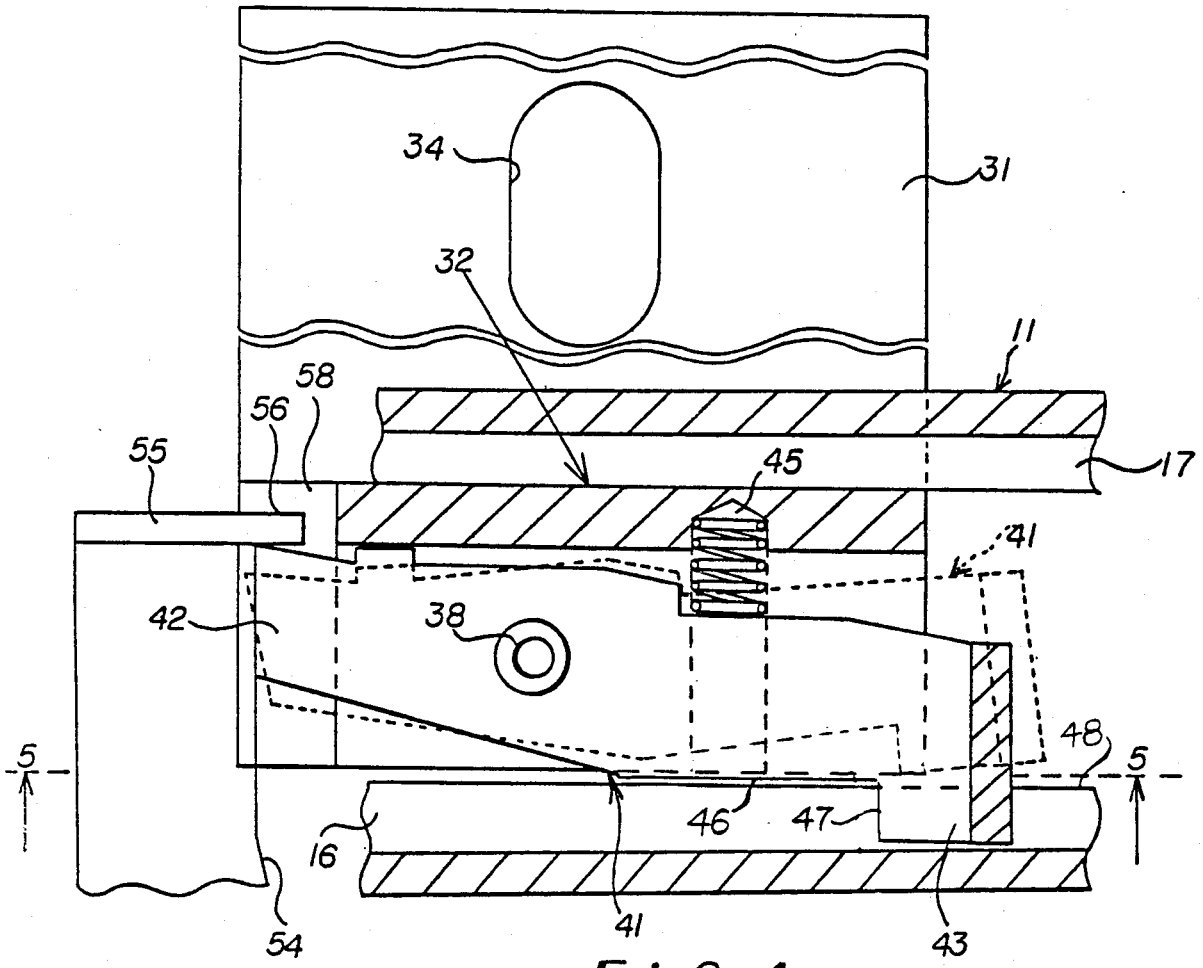
FIG. 4 is a schematic cross-sectional view taken along lines 4—4 of FIG. 3.
Figure 5:
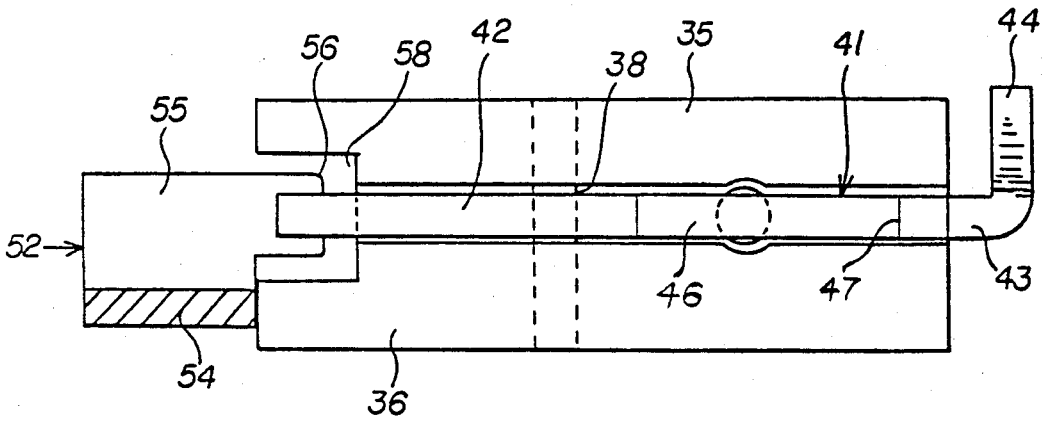
FIG. 5 is a schematic cross-sectional view taken along lines 5—5 of FIG. 4.

As shown in FIGS. 3–5, the latch assembly 22 includes a flat base portion 31 and a latch body portion 32 that extends into the channel 15. Securing the latch assembly 22 to the support surface 18 is a screw 33 extending through an elongated alignment opening 34 in the base portion 31. The latch body 32 is formed by a pair of bifurcated legs 35, 36 joined at one end by a connecting portion 37. Pivotally retained between the leg portions 35, 36 by a pin 38 is a pivot member 41 movable between a locked position shown by solid lines and a release position shown by dotted lines in FIG. 4. The pivot member 41 includes a release portion 42 located on one side of the pin 38 and a locking portion 43 located on the opposite side thereof. An edge 46 of the locking portion includes a step that defines an abutment edge 47 extending substantially perpendicular to the outer lip 16. Extending orthogonally from the end of the locking portion 43 is a curved cam portion 44 shown most clearly in FIG. 3.

A spring member 45 positioned between the locking portion 43 and the connecting portion 37 of the latch body 32 biases the pivot member 41 into the locked position shown by solid lines in FIG. 4. When in that locked position, the locking portion 43 extends over the inner surface of the outer lip 16 so as to retain the latch body 32 within the channel 15. It will be obvious that the three positions of engagement between the fixed catches 21, 22 and the frame body 11 prevent movement thereof in a direction perpendicular to the surface 18. Furthermore, horizontal movement of the frame member 11 on the catches 21, 22 in a plane parallel to the surface 18 is limited in opposite directions by engagement between one of the brackets 21 and a corresponding upper corner of the frame member 11. Thus, with the pivot member 41 of the latch assembly 32 in its locked position, the frame body 11 cannot be removed from the support surface 18.

To mount the frame 11, the brackets 21 are first secured to the support surface 18 in horizontally aligned positions at the desired elevation. The latch assembly 22 is then fixed to the surface 18 in a position between the brackets 21 and vertically spaced therefrom a distance determined by the length of the frame body 11. The elongated opening 34 in the latch base portion 31 is used to provide required vertical positioning of the latch assembly 22. With the catch members 21, 22 in position on the surface 18, the top leg of the frame body 11 is engaged to the bracket members 21. This engagement is facilitated by tilting the bottom portion of the frame body 11 away from the support surface 18 so as to permit entry of the hook portions 24 into the channel 15 (FIG. 2). The bottom leg of the frame body 11 is then moved toward the surface 18 until the cam portion 44 of the pivot member 41 (FIG. 3) engages the outer surface of the outer lip 16. Further inward movement of the frame body 11 cams the pivot member 41 into the release position shown by dotted lines in FIG. 4 as the latch body 31 enters a cavity portion of the channel 15. After movement of the pivot member 41 by the outer lip 16, the spring member 45 forces the pivot member 41 back into its locked position shown by solid lines in FIG. 4. In that position the locking portion 43 is engageable with the inner surface of the outer lip 16 so as to substantially restrict relative perpendicular movement between the frame body 11 and the surface 18. Furthermore, any contact between the edge 46 of the pivot member 41 and the outer edge 48 of the lip 16 caused by a rocking motion of the frame along a vertical axis thereof will not cam the member 41 into its fully released position because of engagement between the lip edge 48 and the abutment edge 47.

Figure 6:
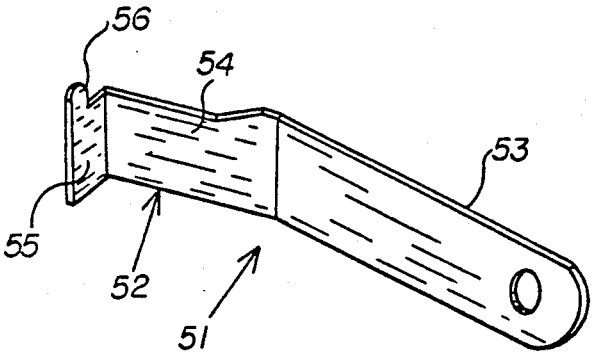
FIG. 6 is a schematic perspective view of an actuator key for use with the latch assembly in FIGS. 3–5.

Referring now to FIG. 6, there is illustrated an actuator key 51 for use in removing the frame body 11 from the support surface 18. The key 51 comprises an actuator portion 52 joined at an angle to a handle portion 53. Forming the actuator portion 52 is a planar mid-portion 54, a first projection portion 55 extending orthogonally therefrom and a second projection portion 56 extending from the first portion 55 in a direction parallel to the planar mid-portion 54.

During removal of the frame body 11, the handle portion 53 of the key 51 is manipulated to pass the mid-portion 54 between the rear surface of the frame and the support surface 18 as shown in FIG. 3. After being positioned between the frame 11 and the surface 18 the actuator 51 is moved toward the latch body 32 into the relative position indicated in FIG. 4. During this latter movement, the second projection portion 56 enters a chamber 58 formed between the bifurcated legs 35, 36 and moves behind the release portion 42 of the pivot member 41. Subsequent outward movement of the actuator 51 first produces engagement between the second projection portion 56 and the release portion 42 and then moves the pivot member 41 into the release position shown by dotted lines in FIG. 4. The bottom leg of the frame body 11 can then be moved away from the latch body 32. After separation of the channel 15 and the latch body 32, the top leg portion of the frame body 11 is easily disengaged from the brackets 21 permitting removal of the frame body 11 from the support surface 18.

It will be noted that the release portion 42 of the latch assembly 32 is positioned behind the frame body 11 so as to be concealed from the view of a potential thief. In addition, the shaping and arrangement of the latch body 32 renders the release portion 42 mechanically accessible only to an implement having a particular shape of the actuator key 51. For those reasons, removal of the frame body 11 is not possible by one unfamiliar with the latch assembly 22 or not in possession of a suitable actuator 51.

Obviously, many modifications and variations of the present invention are possible in light of the above teachings. It is to be understood, therefore, that the invention can be practiced otherwise than as specifically described.

What is claimed is:

1. A frame apparatus comprising:

a frame body adapted to retain a display article and having a rear surface for attachment to a support surface, the perimeter of said rear surface defined by rearwardly facing channels terminated with inwardly extending lips;

releaseable latch means for attaching said rear surface to the support surface and movable between a locked position preventing removal of said frame body from the support surface and a release position allowing removal thereof, said latch means comprising release means disposed between and substantially concealed by said frame body and the support surface and operable to move said latch means into said release position to allow removal of said frame body; and a plurality of spaced apart catch bracket means for mounting on the support surface; each said catch bracket means comprising a base portion projecting away from the support surface, a hook portion extending substantially parallel to the support surface and engaged by one of said lips, and bracket securing means comprising one portion engaging said base portion and another portion engaging the support surface, and wherein said base portions, said hook portions and said one portions of said securing means are substantially completely retained by said channels.

2. Apparatus according to claim 1 wherein said frame body further defines spaced apart retaining flange portions extending inwardly from said channels and adapted to straddle the outer periphery of the display article.

3. Apparatus according to claim 2 wherein said bracket securing means comprise a member engaging said base portion and adapted to penetrate the support surface.

4. Apparatus according to claim 2 wherein said latch means comprises a pivot member adapted to be releasably engaged by a cavity portion of said channels.

5. Apparatus according to claim 4 wherein said latch means comprises bias means biasing said latch means into said locked position.

6. Apparatus according to claim 5 wherein said rear surface and said latch means are shaped and arranged such that during movement of said frame body into position on the support surface said rear surface first engages and moves said pivot member into said release position and then permits said bias means to move said pivot member into said locked position and within said cavity portion.

7. Apparatus according to claim 1 including an actuator having a handle portion and an actuator portion, said actuator being adapted for manual manipulation whereby said actuator portion passes between the support surface and said rear surface to contact said pivot member and release said latch means.

8. A frame apparatus comprising:

a frame body adapted to retain a display article and having a rear surface for attachment to a support surface, said rear surface defining rearwardly facing channels terminating with inwardly extending lips;

a plurality of spaced apart catch means for mounting on the support surface and adapted to releasably engage said channels; and releasable latch means comprising a latch body for attachment to the support surface and a pivot member pivotally retained by said latch body and movable between a locked position preventing removal of said frame body from the support surface and a release position allowing removal thereof, said pivot member defining a locking portion adapted to engage an inner surface of one of said lips when in said locked position and a release portion operable to move said pivot member into said release position to allow removal of said frame body, said release portion being disposed between and substantially concealed by said frame body and the support surface, and said locking portion having a step portion defining an abutment edge extending substantially perpendicular to said engaged lip.

9. Apparatus according to claim 8 wherein said latch means further comprises bias means biasing said latch means into said locked position.

10. Apparatus according to claim 9 wherein a retainer cavity portion of said channels and said latch means are shaped and arranged such that during movement of said frame body into position on the support surface said rear surface first engages and moves said pivot member into said release position and then permits said bias means to move said pivot member into said locked position and within said retainer cavity portion.

11. Apparatus according to claim 10 including an actuator having a handle portion and an actuator portion, said actuator being adapted for manual manipulation whereby said actuator portion passes between the support surface and said rear surface to contact said release portion and move said pivot member into said release position.

12. Apparatus according to claim 11 wherein said pivot member comprises a cam portion adapted to engage an outer surface of said engaged lip and be forced thereby into said release position during movement of said locking portion into said cavity portion.

13. Apparatus according to claim 12 wherein said latch body defines a chamber retaining said release portion; and said actuator portion comprises a planar mid-portion for passage between said frame body and the support surface, a first projection portion for entering said channel and extending transversely from said mid-portion, and a second projection extending from said first projection portion in a direction parallel to said mid-portion and adapted to enter said chamber and engage said release portion.

14. Apparatus according to claim 8 wherein said catch means comprise brackets completely retained within receptacle portions of said channels when engaged therewith.

15. Apparatus according to claim 14 wherein said bracket means comprises bracket securing means for securing said bracket means to the support surface, and wherein said bracket securing means is retained within said receptacle portions.

16. Apparatus according to claim 15 wherein said brackets comprise base portions projecting away from the support surface and hook portions extending substantially parallel to the support surface and engaged by said lips.

17. Apparatus according to claim 16 wherein said bracket securing means comprises a member engaging each said base portion and adapted to penetrate the support surface.

18. Apparatus according to claim 14 including an actuator having a handle portion and an actuator portion, said actuator being adapted for manual manipulation whereby said actuator portion passes between the support surface and said rear surface to contact said release portion and move said pivot members into said release position.

* * * * *